United States Patent [19]

Firey

[11] Patent Number: 4,903,793

[45] Date of Patent: Feb. 27, 1990

[54] NOISE SUPPRESSION BY GAS LIQUID MIXTURE

[76] Inventor: Joseph C. Firey, P.O. Box 15514, Seattle, Wash. 98115-0514

[21] Appl. No.: 350,800

[22] Filed: May 11, 1989

[51] Int. Cl.[4] ..... G10K 11/00

[52] U.S. Cl. ..... 181/0.5; 181/198; 181/200; 367/1

[58] Field of Search ..... 367/1, 191; 181/0.5, 181/198, 200, 260

[56] References Cited

U.S. PATENT DOCUMENTS 3,212,602 10/1965 Jones et al. .
3,316,840 5/1967 Grand .
3,483,132 12/1969 Bernd .

*Primary Examiner*—Charles T. Jordan
*Assistant Examiner*—J. Woodrow Eldred

[57] ABSTRACT

Gas liquid mixtures readily absorb the wave energy of noise and thus reduce noise intensity. By circulating gas liquid mixtures through jackets surrounding noisy machines, such as internal combustion engines, undesirable noise can be reduced.

6 Claims, 5 Drawing Sheets

NOISE SUPPRESSION BY GAS LIQUID MIXTURE

BACKGROUND OF THE INVENTION

1. Field of the invention

This invention is in the field of noise suppression and sound absorption for noisy machines and devices.

2. Description of the prior art

In many places noisy machines are objectionable and a public nuisance. In the prior art, such noise was suppressed by use of noisy sound absorbing materials placed around the machine. These prior art sound absorbing materials are commonly solids, often in fibrous or particle form, such as fiberglass mats, wood fiber mats, sawdust inclosed between boards, acoustic tiles, etc. Almost any degree of noise suppression can be achieved by use of a sufficient thickness of these prior art sound absorbers but the cost is thusly increased and more space is taken up as greater noise suppression is achieved. It would be desirable to have available a sound absorbing material of great effectiveness at small thicknesses.

A typical and common example of a noisy machine is the internal combustion engine such as the gasoline engine, as used in automobiles, and the diesel engine, as used in automobiles, trucks, and buses. Most of theses internal combustion engines are liquid cooled and are thus fitted with a cooling jacket which surrounds the engine cylinder and combustion chamber. This cooling jacket is also a means for containing a fluid and is fitted with a fluid inlet and a fluid outlet. Wood chippers for chopping up tree wastes are another example of a noisy machine. High speed blowers such as are used in some industrial type vacuum cleaners and blowers are also usually very noisy as are some types of high pressure hydraulic pumping devices.

SUMMARY OF THE INVENTION

For this invention a mixture of gas bubbles in liquid is created, in a means for creating a mixture, and this mixture is circulated, by a means for circulating, through a jacket containing means which largely surrounds the noisy machine. Sound waves passing through this mixtureof gas bubbles in liquid are greatly reduced in strength, partly by wave scattering from the bubble surfaces, and partly by the irreversible wave compression and expansion of the mixture. In this way the noise created by the machine is largely absorbed by the gas bubble in liquid mixture within the jacket surrounding the machine and this is a principal beneficial object of this invention.

Figure 2:
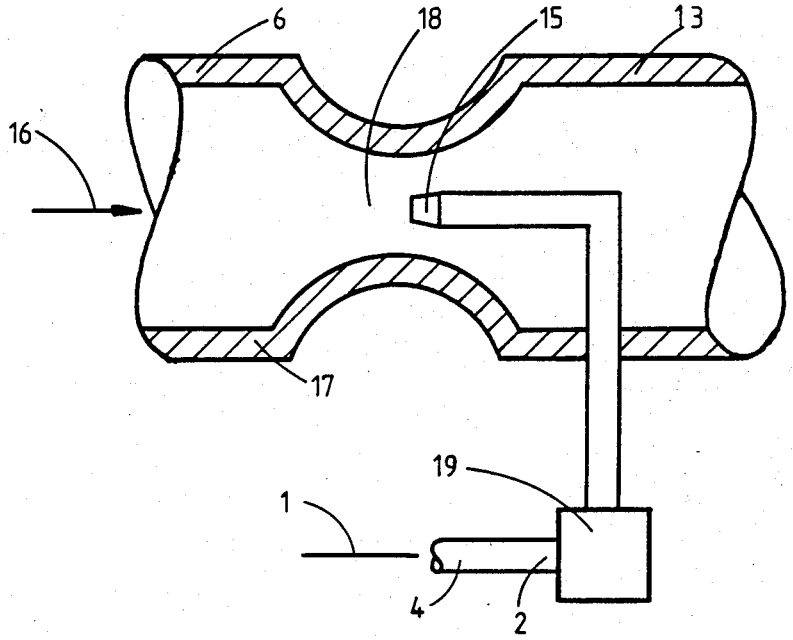

One type of gas-liquid mixer element is shown in cross section in FIG. 2.

Figure 3:
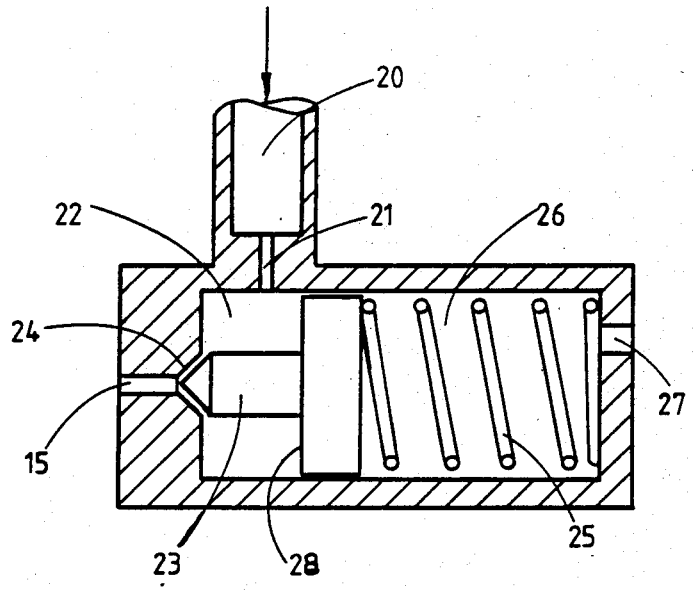

A pulsating gas flow nozzle for use in gas-liquid mixers is shown in cross section in FIG. 3.

Figure 4:
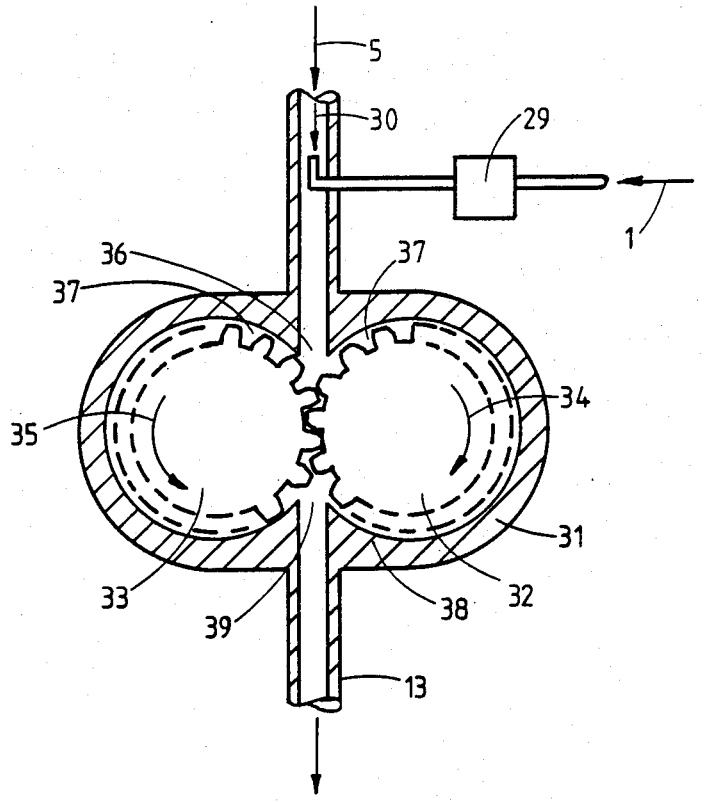

A mixture circulating means is shown in cross section in FIG. 4.

Figure 5:
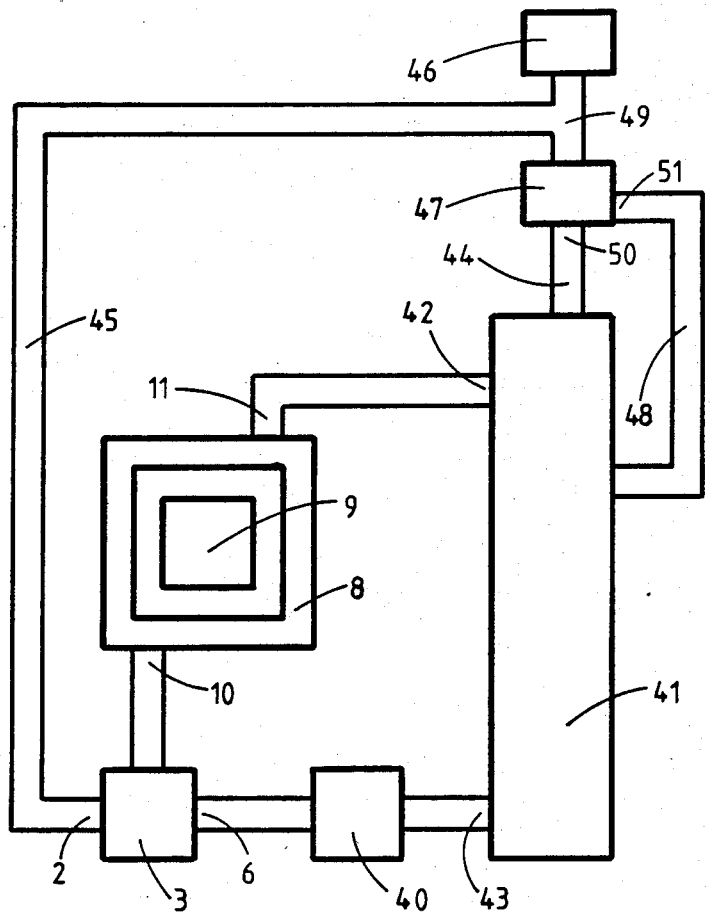

A schematic diagram of another form of the invention is shown in FIG. 5.

DESCRIPTION OF THE PREFERRED EMBODIMENTS:

All forms of this invention comprise the following elements:

1. A means for creating a mixture of gas bubbles in liquid, a source of gas and a source of liquid and these connected to this mixer means;
2. A jacket means for containing a fluid comprising a fluid inlet and a fluid outlet;
3. A means for positioning the jacket containing means so that it largely surrounds the noisy machine;
4. A means for circulating the mixture of gas bubbles in liquid from the mixer means through the jacket means for containing from the inlet to the outlet thereof.

In this way the noisy machine becomes largely surrounded by a mixture of gas bubbles in liquid and the noise of the machine can be largely absorbed while passing through this mixture. Several different forms of each of these elements can be used and additional elements can be used, such as a standpipe means from which fluid can be recirculated.

Noise is sound waves of alternate pressure rise and pressure drop. When passing through a compressible fluid, such as a gas, sound waves cause a volume decrease by pressure rise and a volume increase by pressure drop and these alternate volume changes create a mechanical motion of the compressible fluid. Since real fluids are viscous this mechanical motion dissipates some of the wave energy into random molecule motion and the wave pressure range, and hence noise intensity, are reduced in this way when passing through a compressible fluid. Gases are highly compressible so mechanical motion is appreciable but gas viscosity is very low with the result that noise intensity reduction is small upon passage through a gas. Liquids are much more viscous than gases but far less compressible so mechanical motion is very small with the result that noise intensity reduction is again small upon passage through a liquid. When, however, the compressible fluid is a mixture of gas bubbles in a liquid continuum the large mechanical motion within the highly compressible gas is transmitted to the surrounding highly viscous liquid with the result that noise intensity reduction is large upon passage through such a mixture.

Additional noise reduction occurs when sound waves pass through a fluid containing many surfaces of sharp density change. At such surfaces the waves are partially reflected and, if these surfaces are variously oriented, the wave energy is scattered in many different directions thus reducing the wave energy, and hence noise intensity, in the original wave direction. A mixture of gas bubbles in liquid is just such a fluid since at each gas to liquid surface a sharp density change occurs and these surfaces are oriented in all possible directions.

In these and other ways a mixture of gas bubbles within a liquid continuum is a very effective sound absorbing fluid. It is a purpose of this invention to utilize these sound absorbing properties of such gas liquid mixtures in order to suppress the noise created by noisy machines such as internal combustion engines. This purpose is achieved by surrounding the noisy machine with a jacket containing the mixture of gas bubbles in liquid through which the noise waves must pass.

Figure 1:
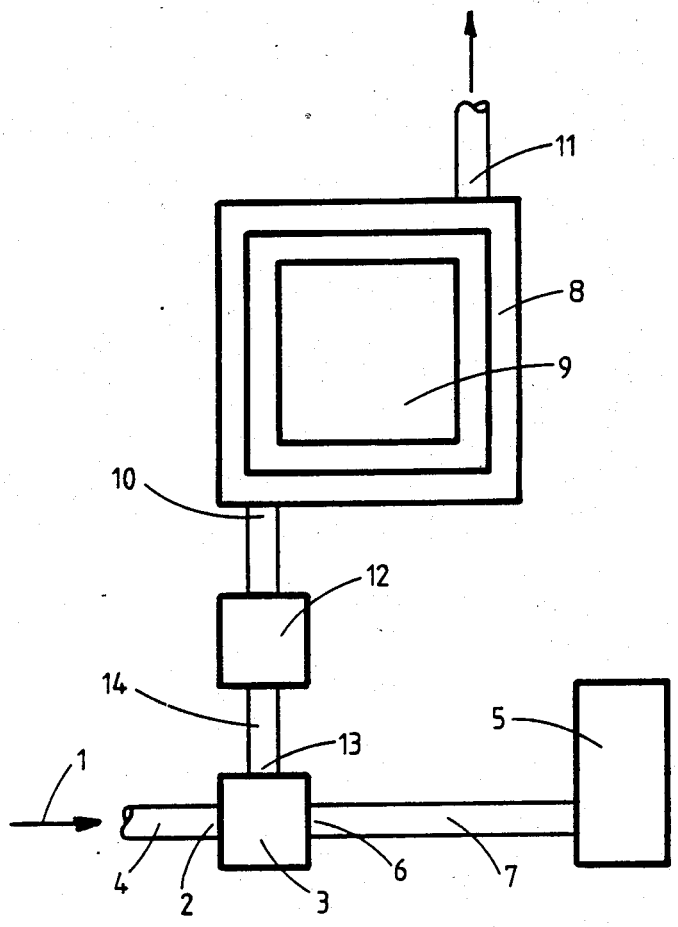
In FIG. 1 is shown a schematic diagram of a simple form of the invention.

On example form of this invention is shown schematically in FIG. 1 and comprises:

a. A gas source, 1, such as atmospheric air, and connecting into the gas inlet, 2, of the mixer means for creating a mixture of gas bubbles in liquid, 3, via the connecting means, 4;

b. A liquid source, 5, such as a water tank or water supply pipe, and connecting into the liquid inlet, 6, of the mixer means, 3, via the connecting means, 7;

c. The mixer means for creating a mixture of gas bubbles in liquid, 3, combines gas from the source, 1, with liquid from the source, 5, into a mixture wherein gas bubbles are suspended within a liquid continuum;

d. A jacket means for containing a fluid, 8, is positioned to largely surround the noisy machine, 9, and has a fluid inlet, 10, and a fluid outlet, 11;

e. A circulating means for circulating a fluid, 12, circulates the gas liquid mixture from the mixture outlet, 13, of the mixer means, 3, via the connecting means, 14, into the fluid inlet, 10, of the jacket means for containing, 8;

f. In this way the noisy machine, 9, is largely surrounded by the mixture of gas bubbles in liquid circulating through the jacket containing means, 8, from the fluid inlet, 10, to the fluid outlet, 11;

g. The noise waves generated by the noisy machine, 9, are obliged to largely pass through this surrounding gas liquid mixture and are greatly absorbed therein.

In this way the machine noise is suppressed which is a principal beneficial object of this invention.

Various kinds of mixer means for creating a mixture of gas bubbles in liquid can be used for this invention as for example:

1. A gas nozzle spraying gas into a moving liquid stream;
2. A cavitating centrifugal pump supplied with gas and liquid at inlet;
3. A gear pump supplied with gas and liquid at inlet;
4. Colloid mills and homogenizers, such as closely spaced counter rotating discs between which gas and liquid are passed together.

One example of a gas nozzle mixer means for creating a mixture of gas bubbles in liquid is shown in cross section FIG. 2 and comprises:

a. A gas nozzle, 15, spraying gas at high velocity into a liquid stream, 16, flowing through a pipe, 17, with a constriction, 18, where the gas enters the liquid;

b. A gas pump, 19, pumping gas from the gas source, 1, up to a high pressure to the gas nozzle, 15, sufficient to give the gas a high velocity upon leaving the nozzle, 15;

The high gas spray velocity together with the high liquid velocity through the constriction, 18, cause flow turbulence and rapid flow fluctuations. this turbulence and flow fluctuation break up the air spray into small bubbles which are suspended within the liquid and this mixture passes out of the mixer means via the mixture outlet, 13. In this way the desired mixture of gas bubbles within a liquid continuum is created by this example mixer means of FIG. 2.

The flow fluctuations and flow turbulence generated where the gas and liquid flow together can be increased by use of a pulsating gas spray nozzle in the mixer means of FIG. 2. One example of such a pulsating gas spray nozzle is shown in cross section in FIG. 3 and comprises:

a. A compressed gas inlet, 20, with a flow restriction, 21, supplying compressed gas into the plunger volume, 22;

b. A nozzle valve plunger, 23, which stops gas flow when seated against the valve seat, 24, and which allows gas flow through the spray nozzle, 15, when unseated from the valve seat, 24;

c. A nozzle valve spring, 25, acting to force the plunger, 23, against the valve seat, 24, and located inside a chamber, 26, vented to atmosphere, or other low pressure, via the vent, 27;

The gas pressure within the plunger volume, 22, acts on the plunger surface, 28, to unseat the plunger, 23, from the valve seat, 24. The spring, 25, is sized so that the plunger, 23, is unseated when the gas pressure in the plunger volume 22, equals or exceeds some fraction, say one-half or two-thirds, of the gas pressure at inlet, 20. When the plunger, 23, is seated on the valve seat, 24, gas flows from the inlet, 20, through the restrictor, 21, into the plunger volume, 22, thus increasing the pressure therein until it is sufficient to unseat the plunger, 23, from the valve seat, 24, against the spring, 25. When the plunger, 23, is thus unseated from the valve seat, 24, gas flows from the inlet, 20, through the restrictor, 21, through the plunger volume 22, and out through the spray nozzle, 15, into the liquid beyond. This outflow of gas eventually reduces the pressure in the plunger chamber, 22, sufficiently that the spring, 25, forces the plunger, 23, again against the valve seat, 24, thus stopping the gas flow through the spray nozzle, 15. This cycle of intermittent gas flow is continuously repeated thus creating pulsating and intermittent gas flow into the liquid. The time duration of each single cycle of gas flow and stoppage can be set by selection of the gas pressure at supply, 20, the size of the restriction, 21, the size of the plunger volume, 22, the strength of the spring, 25, the area of the plunger, 28, acted on by the gas pressure in the plunger volume, 22, the size of the gas spray nozzle, 15, and the mass of the plunger, 23, by methods already well-known in the art of spray nozzles.

Only a single gas spray nozzle, 15, is shown in FIG. 1 but two or more such nozzles could also be used to distribute the air more uniformly within the liquid. Also one or more flexible gas spray nozzles could be used which would vibrate back and forth across the liquid stream and thus distribute the air bubbles more uniformly within the liquid.

Another example of a mixer means for creating a mixture of gas bubbles in liquid is shown in cross section in FIG. 4 and comprises:

a. A gas pump, 29, pumping gas from the gas source, 1, into a liquid stream, 30, from the liquid source, 5;

b. A gear pump, 31, with two meshed, counterrotating gears, 32, 33, rotating as shown by the arrows, 34, 35, by action of the gear pump drive means;

c. Where the gear teeth disengage in region, 36, a suction is created which draws in the liquid and gas to be carried around in the gear tooth gaps, 37, within the housing, 38;

d. Where the gear teeth reengage in region, 39, the liquid and gas are forced out from between the gear teeth and the resulting fluid motion and turbulence break up the gas portions into small bubbles suspended in the liquid;

e. The gas in liquid mixture thus created is also forced by the gear tooth reengagement out through the mixture outlet, 13, and in this way the mixer means shown in FIG. 4 can also function as a circulating means for circulating the mixture of gas bubbles in liquid through the jacket means for containing a fluid.

Various kinds of means for circulating the mixture of gas bubbles in liquid from the mixer means through the jacket means for containing a fluid from the inlet to the outlet thereof such as for example:

1. A gear pump and drive means as described hereinabove;
2. A centrifugal pump and drive means;
3. A piston and cylinder pump and drive means;
4. Various other kinds of pumps with drive means;
5. Thermosyphon circulating means can be used where the gas liquid mixture is alternately heated and cooled as in an internal combustion engine jacket with cooling radiator;
6. The gas nozzle mixer means of FIG. 2 can also function as a circulating means. The high velocity gas spray entrains liquid and thus circulates the mixture. But the liquid and mixture flow directions will then be the same as the gas spray direction and hence opposite to the flow directions shown in FIG. 2.

The circulating means, 12, can be located as shown in FIG. 1 to pump gas liquid mixture from the mixer means, 3, into the jacket containing means, 8, via the inlet, 10. Alternatively the circulating means, 40, can be located as shown in FIG. 5, to pump fluid into the mixer means, 3, thus forcing gas liquid mixture created therein to flow into the jacket containing means, 8, via the inlet 10.

As described hereinabove the circulating means may also be a mixer means. Additionally such a combined circulating and mixing means can function as a supplementary mixer means to a separate mixer means such as a gas nozzle sprayer which could precede the combined circulating and mixing means in the fluid flow direction.

Atmospheric air is the most readily available gas source but other gases can be used and supplied from pressurized gas cylinders, or gas holders, or gas generators, as a gas source.

Water from a tank or pond is usually the most readily available liquid source but other liquids such as hydrocarbon liquids or antifreeze liquids can be used as liquid source.

For internal combustion engines the jacket means for containing a fluid is usually already built into the engine in the form of the engine cooling jacket. This engine jacket is thus positioned to largely surround the engine cylinder and combustion chamber from which an appreciable portion of the engine noise originates. For other kinds of noisy machines, not requiring a cooling jacket, a special jacket containing means is needed together with positioning means, such as brackets, etc. to position the jacket containing means to largely surround the noisy machine.

A significant advantage of the form of this invention shown in FIG. 1 is that the gas and liquid, after mixing, pass but once through the jacket container and are then discarded. Where air and water are used as gas and liquid, and are readily available, this form of the invention may be usable. When, however, a more costly liquid, such as an antifreeze liquid, is used we will much prefer to recirculate the liquid back to the liquid source for reuse again. For this purpose a standpipe can be used, receiving at its inlet fluid from the outlet of the jacket containing means, separating some gas from the fluid, venting the separated gases, and returning from the outlet the liquid for recirculation back to the mixer means. Such a standpipe thus becomes the liquid source. For an internal combustion engine this standpipe could be the radiator also used to cool the circulating fluid.

An example of a standpipe liquid source is shown schematically in FIG. 5 and comprises:

a. A noisy machine, 9, surrounded by a jacket containing means, 8, with jacket inlet, 10, and jacket outlet, 11;
b. A mixer means, 3, supplied with gas at its gas inlet, 2, and with liquid at its liquid inlet, 6, and delivering gas liquid mixture to the jacket inlet, 10;
c. A standpipe, 41, receiving fluid at its upper end from the jacket outlet, 11, at the standpipe fluid inlet, 42, and supplying liquid as a liquid source from the standpipe fluid outlet, 43, at its lower end, to the circulating means, 40;
d. A circulating means, 40, circulating liquid from the standpipe fluid outlet, 43, to the mixer liquid inlet, 6;
e. The standpipe, 41, is also fitted with a standpipe vent, 44, to vent those gas postions which separate from the liquid.

With this standpipe form of the invention the liquid is continuously recirculated through the mixer means, the circulating means, the jacket containing means and the standpipe and little or no liquid need be lost or discarded.

In some applications we may wish also to recirculate those gas portions which separate from the gas liquid mixture in the standpipe, 41, and this can be achieved by connecting the standpipe vent, 44, to the gas inlet, 2, of the mixer means, 3, via the gas source connection, 45. Where excess pressure may develop within the fluid circulating system, as when the circulating fluid is heated, a pressure relief valve, 46, can be installed and set to open and vent gases at the selected maximum intended operating pressure.

To remove entrained liquid from those gas portions being recirculated a separator means for separating a gas from a liquid, 47, can be connected via its mixture inlet, 50, to the standpipe vent, 44. Separated liquid leaves via the separated liquid outlet, 51, and returns via the connection, 48, to the standpipe liquid source, 41. Separated gas leaves the separated gas outlet, 49, and can be recirculated via the gas source connection, 45. Any of various kinds of gas liquid separator means can be used such as cyclone separators, cavity separators, etc.

Having thus described by invention what I claim is:

1. The combustion of a noisy machine:

wherein the improvement comprises:

jacket means for containing a fluid and comprising a fluid inlet and a fluid outlet;

positioning means for positioning said jacket means for containing to largely surround said noisy machine;

a source of gas;

a source of liquid comprising a liquid source inlet and a liquid source outlet;

mixer means for creating a mixture of gas bubbles within a liquid comprising a gas inlet, a liquid inlet and a mixer outlet;

means for circulating said mixture of gas bubbles in liquid from said mixer outlet through said jacket containing means from said fluid inlet thereof to said fluid outlet thereof;

means for connecting said gas source to said gas inlet of said means for creating a mixture;

means for connecting said liquid source outlet to said liquid inlet of said means for creating a mixture.

2. The combination of a noisy machine as described in claim 1:

wherein said liquid source comprises standpipe means for containing said mixture of gas bubbles in liquid comprising a standpipe fluid inlet, a standpipe fluid outlet, and a standpipe vent;

and further wherein said means for circulating said mixture of gas bubbles in liquid through said jacket containing means also circulates said mixture through said liquid source from said liquid source inlet to said liquid source outlet.

3. The combination of a noisy machine as described in claim 2:

and further comprising:

means for separating a gas from a liquid and comprising a gas liquid mixture inlet, a separated gas outlet, and a separated liquid outlet;

means for connecting said separated liquid outlet to said liquid source;

means for connecting said gas liquid mixture inlet to said standpipe vent;

means for connecting said separated gas outlet to said gas source.

4. The combination of a noisy machine as described in claim 1:

wherein said noisy machine comprises an internal combustion engine and further wherein said jacket means for containing comprises the engine cooling jacket. jacket.

5. The combination of a noisy machine as described in claim 4:

wherein said liquid source comprises radiator means for cooling said mixture of gas bubbles in liquid comprising a radiator fluid inlet, a radiator fluid outlet, and a radiator vent;

and further wherein said means for circulating said mixture of gas bubbles in liquid through said jacket containing means also circulates said mixture through said liquid source from said liquid source inlet to said liquid source outlet.

6. The combination of a noisy machine as described in claim 5:

and further comprising:

means for separating a gas from a liquid and comprising a gas liquid mixture inlet, a separated gas outlet, and a separated liquid outlet;

means for connecting said separated liquid outlet to said liquid source;

means for connecting said gas liquid mixture inlet to said radiator vent;

means for connecting said separated gas outlet to said gas source.

* * * * *

UNITED STATES PATENT AND TRADEMARK OFFICE

CERTIFICATE OF CORRECTION

PATENT NO. : 4903793

DATED : February 27, 1990

INVENTOR(S) : Joseph C. Firey

It is certified that error appears in the above-identified patent and that said Letters Patent is hereby corrected as shown below:

Column 6, line 43: delete, "by", and insert, --my--.

Column 6, line 44: delete, "combustion," and insert, --combination--.

Column 8, line 2: delete the second "jacket."

Signed and Sealed this

Twenty-eighth Day of May, 1991

*Attest:*

HARRY F. MANBECK, JR.

*Attesting Officer*

*Commissioner of Patents and Trademarks*